United States Patent [19]

Leckband et al.

[11] 3,940,906

[45] Mar. 2, 1976

[54] METHOD OF AND APPARATUS FOR FORMING PACKAGES

[75] Inventors: Lee M. Leckband; Steven W. Taatjes, both of Lindsay, Calif.

[73] Assignee: FMC Corporation, San Jose, Calif.

[22] Filed: Nov. 4, 1974

[21] Appl. No.: 520,681

[52] U.S. Cl. ..... 53/29; 53/59 R; 53/183; 53/193

[51] Int. Cl.[2] ..... B65B 57/14; B65B 9/16

[58] Field of Search ..... 53/29, 59 R, 183, 180, 53/182, 193; 222/557

[56] References Cited

UNITED STATES PATENTS

| | | | |
|---|---|---|---|
| 2,113,636 | 4/1938 | Vogt | 53/180 X |
| 2,380,647 | 7/1945 | Henderson | 222/557 |
| 2,656,658 | 10/1953 | Grady | 53/193 |
| 3,200,559 | 8/1965 | Curtis | 53/59 R X |
| 3,553,924 | 1/1971 | Bonami | 53/193 X |
| 3,726,060 | 4/1973 | McMillan | 53/193 X |

*Primary Examiner*—Travis S. McGehee
*Attorney, Agent, or Firm*—R. S. Kelly; J. W. Edwards; C. E. Tripp

[57] ABSTRACT

A supply of hose-shaped wrapping material is pleated axially and fits telescopically about the outer surface of a forming tube. A portion of the wrapping material extends over the upper rim of the tube and downwardly through the tube bore to a position below the lower rim of the tube where it is fastened in a tightly gathered together manner. A gate, positioned below the lower rim of the tube, supports articles fed into the wrapping material in the tube bore. This gate is movable to a position which allows the articles and wrapping material to drop downwardly through the bore to a position below the gate. Such downward movement of the wrapping material draws another portion of wrapping material into the bore of the forming tube. By supporting the wrapping material and accumulated articles at a position above the fastened end of the wrapping material, the lowermost article within the wrapping material will drop from the position of support to the fastened end of the wrapping material upon removal of the support. This results in a downward pull on the wrapping material to break up any bridging of articles in the tube. After one batch of articles in the wrapping material has dropped below the gate, the gate returns to a position underlying the forming tube for supporting another batch of articles while the wrapping material below the gate and above the first batch of articles is being fastened and severed to provide the completed article package.

10 Claims, 10 Drawing Figures

20
26
22
24
23
90
28
32
30
34
103
F

METHOD OF AND APPARATUS FOR FORMING PACKAGES

BACKGROUND OF THE INVENTION

1. Field of the Invention

This invention relates to package forming, and more particularly, it pertains to a method of and apparatus for packaging articles in a hose-shaped wrapper.

2. Description of the Prior Art

Net bags have been favorably received in marketing channels for packaging produce, such as citrus fruit, because they improve package appearance and quality maintenance of the produce. The fruit is exposed to air within the net bags and thus can breathe, while in polyethylene film bags, which have also been used in packaging fruit, air circulation is limited even when such bags are provided with special breathing holes. Premanufactured net bags, however, cost about twice as much as bags made of polyethylene film and require special equipment for opening and filling. Thus, despite their obvious advantages, they have not been readily accepted by the fruit and produce packaging industry.

Net bagging material, typically of polyethylene, is provided by the manufacturer generally in the form of a long rope of unstretched tubing with the tubing being provided in continuous form on a coil. In order to adapt such material for use with conventional produce filling equipment, the net tubing must first be severed and made into bags and then applied to the prior art equipment with special adaptive devices. As mentioned hereinbefore, this has materially increased the costs of packaging and, hence, has not been readily accepted by the industry. There has been a continuing search for a machine which will handle net tubing in its continuous state and form the bags at the same time that the produce is placed therein. One such machine, as used for the citrus bagging market in Florida, is described in a report by the Agricultural Research Service, U.S. Department of Agriculture, entitled "Automatic Produce-Bagging Machine That Uses Factory-Roll Polyethylene Net Tubing ", ARS-S-18, published July 1973. The machine as described operates in a manner whereby the free end portion of a continuous rope of net tubing is brought up into a gripping head and is arranged to be spread open by a device within the tubing. The gripping head elevates the opened, free end of the tubing into a position to receive a batch of fruit. Then, that portion of the net material which is directly above the spreading means is clamped and cut off. Upon completion of the filling of fruit into the separated portion of the tubing, the top thereof is clamped and the completed and filled bag is released.

Other apparatus for packaging articles into bags formed from a continuous supply of hose-shaped material is shown in various prior art patents. For example, U.S. Pat. No. 2,908,123 of Muller et al, issued Oct. 13, 1959, discloses a device for forming filling, closing and disconnecting packages from a supply of hose-shaped, net packing material that is stretched over a filling tube opening and pulled out in lengths as required for each separate package. While the net packing material extends upwardly along the outer surface of a forming tube, over the upper rim of the tube and downwardly through the tube bore, the filling tube, wherein the articles to be packaged are batched, is a separate tube that is placed inside of the hose-shaped packing material.

U.S. Pat. No. 2,706,370 of Snyder, issued Apr. 19, 1955, discloses an apparatus for forming packages with a continuous supply of flexible tubular wrapping material that extends upwardly along the outer surface of a forming tube, over the upper rim of the tube and downwardly into the tube bore where the product is filled for forming a package. The clamping of the wrapping material to form successive packages is performed at both the top and the bottom of the forming tube.

U.S. Pat. No. 2,292,231 of Lesavoy, issued Aug. 4, 1942, discloses an automatic packaging system wherein a double walled bag is formed about the exterior of a vertically positioned product batching tube. Clamping and cutting means are utilized at the lower end of the tube to successively tie and sever the bags after the deposit of product therein. A gate within the batching tube allows the accumulation of a given quantity of the product while a previously filled bag is being closed and detached.

U.S. Pat. No. 2,656,658 of Grady, issued Oct. 27, 1953, discloses a vertically arranged filling tube for a bag making and filling machine. The free end of a longitudinally-compacted length of tubular material is drawn downward past a pair of crimping elements. An electrically-heated filament loop positioned therebetween is used to close, and detach the filled lower-most bag and to close and provide a platform for the lower end of the next bag to permit initiation of filling therein.

Problems encountered with known automatic, apparatus for forming packages from a continuous supply of hose-shaped wrapping material include a tendency for articles to bridge within the filling tube which directs the articles into the wrapping material, thereby causing a jam which an operator must clear. Furthermore, in most of the prior art systems, the bag making steps of forming, filling, closing and severing must be performed successively, instead of simultaneously, and thus, the package forming operation is more time consuming. In those systems which do provide simultaneous bag making and filling, complex machinery is generally required for performing such operation.

Summary of the Invention

With the method and apparatus of the present invention means are provided whereby individual bags are formed from a continuous supply of hose-shaped wrapping material and are simultaneously filled with articles. The apparatus basically comprises a forming tube which is adapted to receive the hose-shaped material about the exterior surface thereof with such material extending over the upper rim and down through the bore of the tube. The articles are filled directly into the tube and the wrapping material therein from above. A shiftable gate is provided directly adjacent to the lower end of the forming tube for supporting the articles within the tube during the filling operation, and, upon the reception of the desired quantity of articles within the tube, the gate is arranged to be opened to permit the packaged articles to drop to the previously applied clamp at the free end of the wrapping material. This movement of the articles automatically feeds another portion of wrapping material into the tube and break up any bridging of articles across the walls of the tube. Means are provided externally of the forming tube for applying a clamp to close the bottom end of the bag into which the articles have just been filled and for severing the proceding filled bag from the end of the wrapping material. In the preferred embodiment of the invention, this clamping and severing mechanism comprises a device which applies two closely spaced clamps (one for closing the top of one bag and the other for closing the bottom of the next succeeding bag) and which severes the wrapping material between the clamps.

While the apparatus of the present invention is basically simple and includes no complex, and hence expensive, mechanisms, it has been found to be extremely effective for the semi-automatic packaging of articles such as citrus fruit for example, into net bags. The shiftable gate permits batching of the articles directly in the forming tube to fill one bag while the end portion of that bag is being clamped and while the preceding bag is being detached, and this is one of the keys to the high speed obtainable with the machine. Also, because the fruit or other articles within the forming tube are allowed to drop once the gate is opened, the consequent pull on the end of the wrapping material results in the breaking up of any bridging of articles within the forming tube. This bridging is a serious problem with certain of the prior art devices which use a forming tube to fill articles such as fruit into a tubular wrapping material.

In field tests of the apparatus of the present invention briefly trained female operators are able to consistently average 10 to 12 bags per minute throughout a single days run. The apparatus has a capability of averaging as much as 14 to 16 bags per minute when operated at high speed by skilled personnel.

DESCRIPTION OF THE PREFERRED EMBODIMENT

Figure 1:
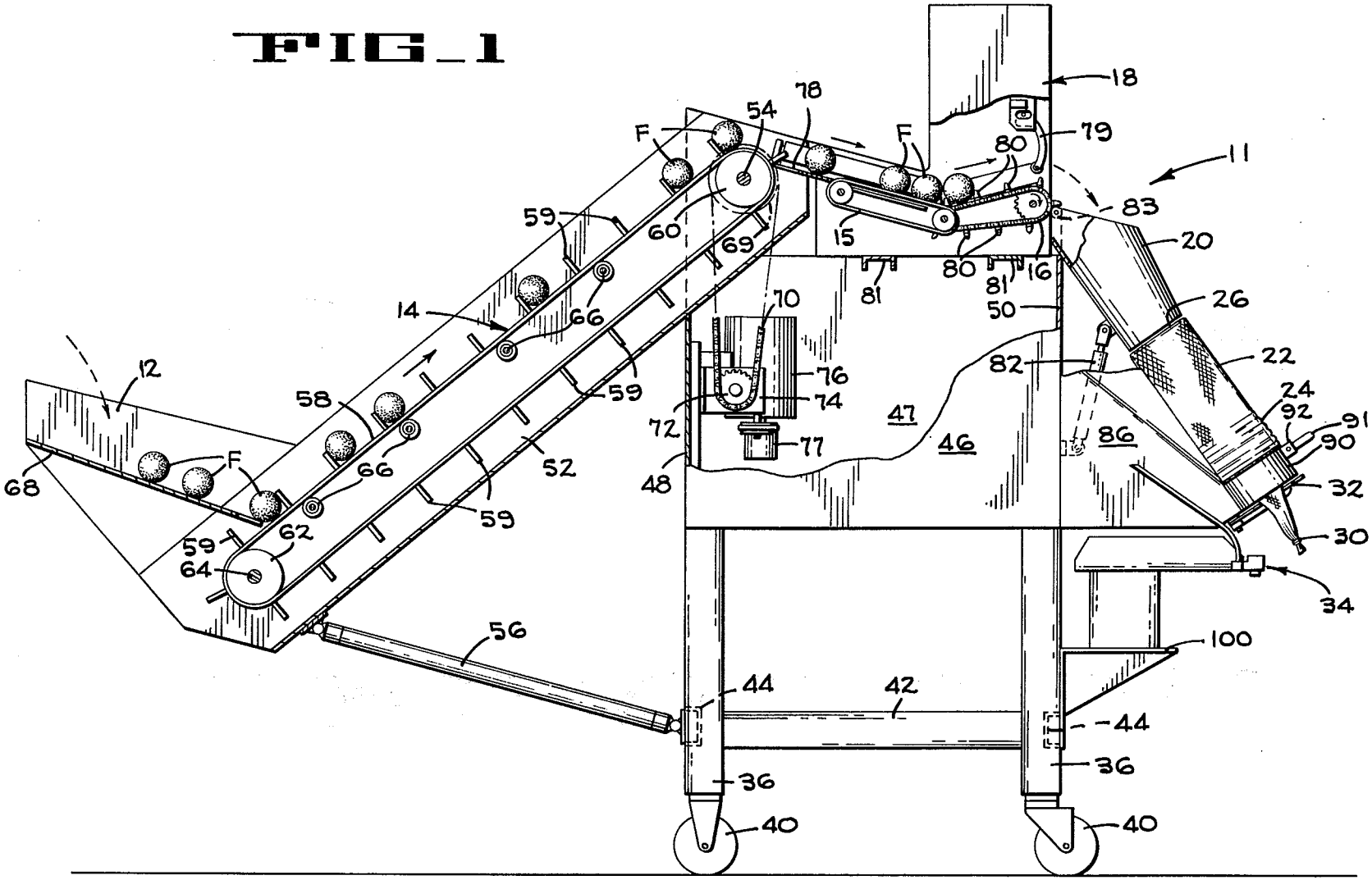
FIG. 1 is a side elevation of a package forming and filling apparatus in which the present invention is embodied with a portion thereof being broken away and shown in section.

Referring to drawing FIG. 1, a package forming and filling apparatus 11 is shown which includes a hopper 12 for receiving a bulk supply of articles such as citrus fruit F, which are to be packed. A conventional peg flite elevator 14 feeds the fruit from the hopper to a counter 18 which includes a counter infeed conveyor section comprised of three parallel sets of endless V-belt conveyors 15 and a counter timing conveyor section comprised of three endless pusher chains 16. The fruit is transported through the counter 18, and, after each individual fruit is counter, it is discharged into a delivery chute 20.

The packaging portion of the apparatus of the present invention includes a forming tube 22 which is mounted below the delivery chute 20 and which is adapted to receive the fruit F therefrom. The forming tube is provided with a supply of hose-shaped polyethylene net wrapping material 24 that fits telescopically about the outer surface of the tube and is pleated axially for longitudinal compaction on the tube. The free end portion of the wrapping material extends over the upper rim 26 of the tube and downwardly through the tube bore to a position below the lower rim 28 of the tube where it can be fastened in a tightly gathered together manner by a staple or clamp 30 to form the bottom closure for the bag into which the fruit are to be packed. A gate 32 is mounted directly below the lower rim of the tube for supporting fruit fed from the delivery chute into the wrapping material within the tube bore, and the gate is arranged to be moved between a position wherein it supports the fruit within the tube and a position out of alignment with the tube to thereby allow the fruit and wrapping material to drop downwardly through the bore to a location below the gate. A fastening and severing mechanism 34 is provided at a position laterally of the gate and at a lower elevation for applying a pair of closely spaced clamps 30 to the wrapping material above the batch of fruit therein and for severing the material therebetween in order to detach the completed package of fruit from the end of the wrapping material and to leave the new free end of the material with a closure (as shown in FIG. 1).

Figure 2:
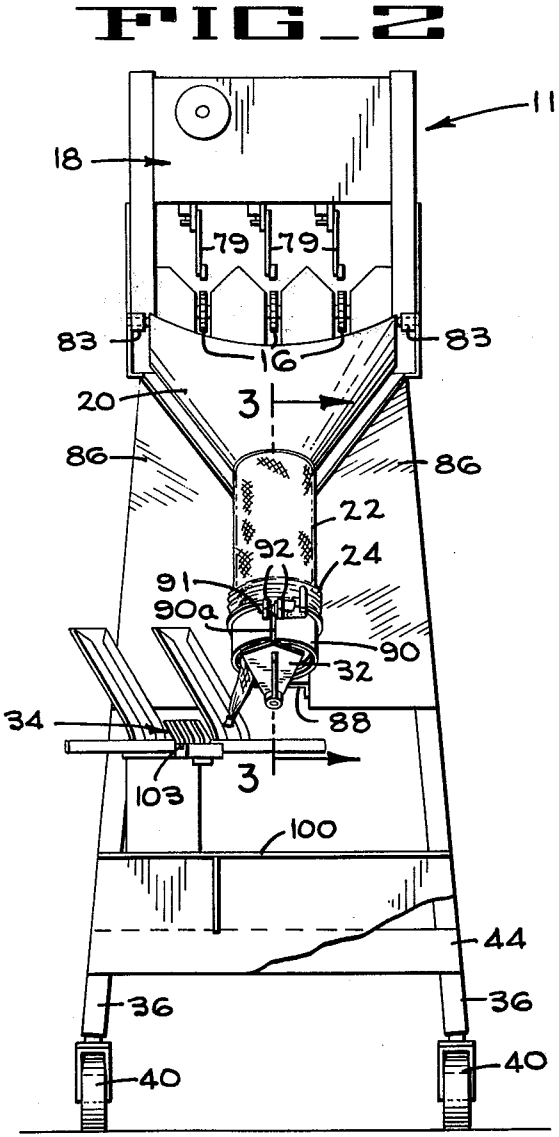
FIG. 2 is a discharge end elevation view of the package forming and filling apparatus shown in FIG. 1.

The package forming and filling apparatus 11 is provided with a main frame that includes four generally vertical support posts 36 (FIG. 1) mounted upon caster wheels 40. The supports are held in spaced relationship by longitudinally braces 42 and by transverse braces 44 (FIG. 2). A pair of panels 46 and 47 are mounted to the posts 36 at the sides of the frame, and a pair of panels 48 and 50 are mounted to the back and to the front of the frame, respectively.

The peg flight elevator 14 (FIG. 1) is mounted for movement within a sheet metal trough 52 that extends through a notch in the back panel 48 and is supported by and pivots on its upper drive shaft 54 which is attached to the side panels 46 and 47 by pivot bearings. The lower end of the trough supports the fruit feed hopper 12 and is held outwardly from the frame by a strut 56 that is connected to the back brace 44. The peg flite elevator 14 is comprised of an endless belt 58 having a series of both longitudinally and laterally spaced pegs 59 projecting outwardly from the surface of the belt to define flights spaced longitudinally of the belt and to define lanes spaced transversely of the belt. The endless belt 58 is trained about an upper drive roller 60 that is mounted on drive shaft 54 and a lower driven roller 62 that is mounted on an idler shaft 64 with both of said shafts being supported by and journalled for rotation in the side walls of the trough 52. A series of idler rollers 66 are positioned at intervals spaced longitudinally along the length of the trough 52 for supporting the upper run of the conveyor belt. Hopper 12, which is supported by the lower end of trough 52, has a bottom wall 68 that directs fruit to the upper run of the belt at a position above the lower driven roller 62. This fruit is carried upwardly by the spaced pegs 59 to the upper drive roller 60. The drive shaft 54 is driven by an elevator drive unit that includes a sprocket wheel 69 mounted on the drive shaft 54, a drive chain 70 trained about the sprocket wheet 69, a sprocket wheel 72 of a gear reducer 74 which powers the drive chain 70, and a motor 76 which drives through the gear reducer. An air-actuated clutch 77 is provided in the elevator drive unit to control the operation of the elevator.

A ramp 78 is positioned at the discharge end of the peg flite elevator 14 to receive the fruit therefrom and to direct it downwardly to the infeed V-belts 15 of the counter 18. The counter 18, as shown in FIG. 1, is arranged to receive the fruit F from ramp 78 and to transport such fruit in single file fashion in three parallel lanes (FIG. 2) past pivotally mounted counter switch actuating arms 79 which are aligned with the lanes. The fruit lanes are comprised of two separate conveyor sections—the downwardly extending infeed conveyor section having three parallel sets of V-belts 15 and the upwardly extending timing conveyor section comprised of three endless pusher chains 16 each of which are aligned in end-to-end relationship with one of the sets of V-belts. The pusher chains have lugs or pushers 80 arranged in a staggered relationship across the counter so that fruit will be discharged from the counter at spaced time intervals. Consequently, by a timed activation of the switches engaged by each of the actuating arms 79, a separate and distinct count can be attained for each fruit discharged from the counter. The counter is supported upon a pair of channels 81 that extend between the side panels 46 and 47. The particular counter shown in FIG. 1 is described more completely in U.S. Pat. No. 3,500,982, and reference to such patent may be had for a further detailed description of the structure and operation of the counter.

The delivery chute 20 has a funnel-like shape and is pivotally mounted to side panels 46 and 47 at the upper end thereof by means of laterally projective trunnions that are rotatably supported by swivel support tubes 83 secured to the side panels (FIG. 2). The delivery chute is supported near its lower end by a pneumatic actuator cylinder 82 so that it extends in a downwardly inclined position (FIG. 1) spaced outwardly from the front panel 50. When it is necessary to remove the forming tube 22 so as to provide a new supply of wrapping material 24 the pneumatic actuator 82 can elevate the delivery chute about its pivotal mountings so that the forming tube can be readily removed and replaced.

Figure 4:
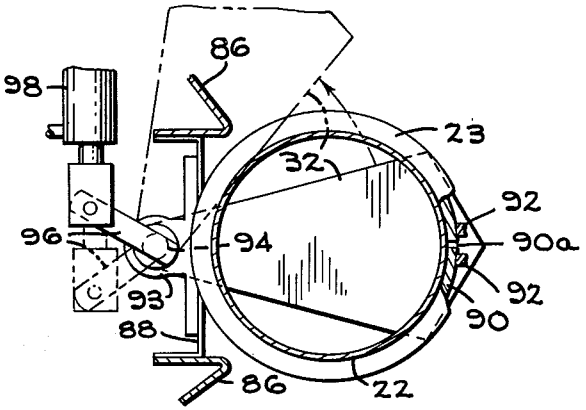
FIG. 4 is a transverse section, taken on the line 4—4 of FIG. 3, illustrating the gate details.

A forming tube support frame is formed by a pair of panels 86 positioned below the delivery chute 20 and attached to the frame structure of the apparatus so as to extend forwardly from the side panels 46 and 47. A channel 88 (FIGS. 2 and 4) is secured between the panels near the adjacent lower ends thereof for supporting a clamp ring 90 that is split axially at 90*a* (FIG. 2) on the opposite side from the support channel 88. The forming tube 22 has a radial flange 23, shown in FIG. 3, that serves as a stop when positioning the wrapping material about the outer surface of the tube. That portion of the tube below flange 23 and the lower rim 28 is arranged to fit within and be held by the clamp ring. The clamp ring is tightened about the forming tube by a toggle clamping mechanism 91 which exerts a force on a pair of ears 92, projecting outwardly from opposite sides of the split 90*a* in the clamp ring, to close and hold the ring in position.

Figure 3:
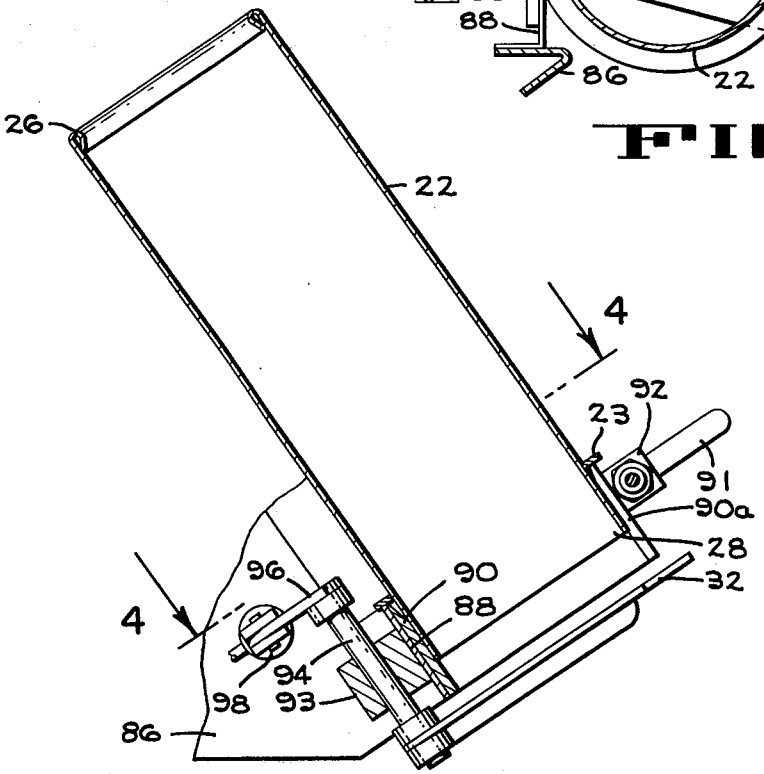
FIG. 3 is an enlarged longitudinal section, taken on the line 3—3 of FIG. 2, illustrating the forming tube and gate.

A bearing member 93 (FIGS. 3 & 4) is mounted to the web of the channel 88, and a shaft 94 is journalled within the bearing member to support the movable gate 32 in a position directly below the lower rim 28 of the forming tube 22. The gate member is rigidly affixed to the lowermost end of the shaft 94 as shown in FIG. 3. A link 96 pivotally connects the upper end of shaft 94 with a pneumatic actuator 98 that provides the power for moving the gate between its closed and opened positions as shown in full and phantom lines, respectively, in FIG. 4.

Figures 7, 8, 9, 10:
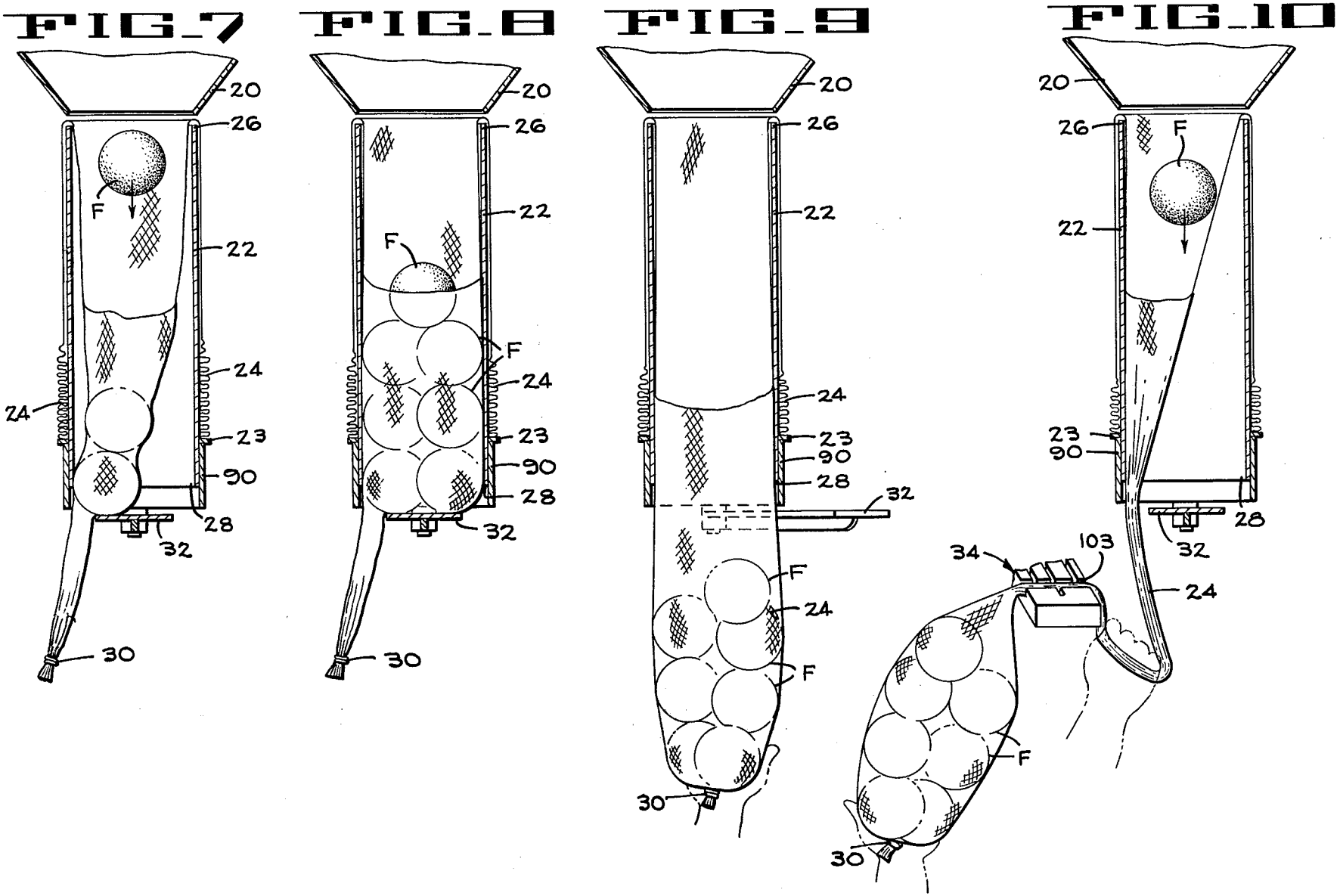
FIGS. 7–10 are operational views illustrating the manner in which a bag is formed and filled using the method of the present invention.

A stapler support bracket 100 is mounted across the front vertical support posts 36 at a position below the gate 32. The fastening and severing mechanism 34 is mounted on the stappler support bracket at a location spaced laterally of the gate 32. The fastening and severing mechanism includes a pair of spaced stapler hammers and a knife blade interposed therebetween that operate together during a single stroke of a pneumatic actuator 102 (FIG. 5) to clench the metal clamps 30 about the hose-shaped wrapping material 22 in a tightly gathered together manner at two spaced locations and to sever the wrapping material between the metal clamps. A groove 103, shown in FIG. 10, is provided in the fastening and severing mechanism so that the wrapping material can be manually inserted between the stapler hammers and opposed anvils. Magazines are provided for feeding commercial, preformed pieces of metal stock (staples) to the staplers with the metal stock being transformed into the metal clamps that fasten the wrapping material. The fastening and severing mechanism 34 is a conventional piece of machinery, and, for example, a device such as shown in the aforementioned U.S. Pat. No. 2,908,123 may be used. The fastening and severing mechanism as shown and described is a Model No. FT-7 "Rocagraph" distributed by the International Staple & Machine Co. of Butler, Pennsylvania.

Figure 5:
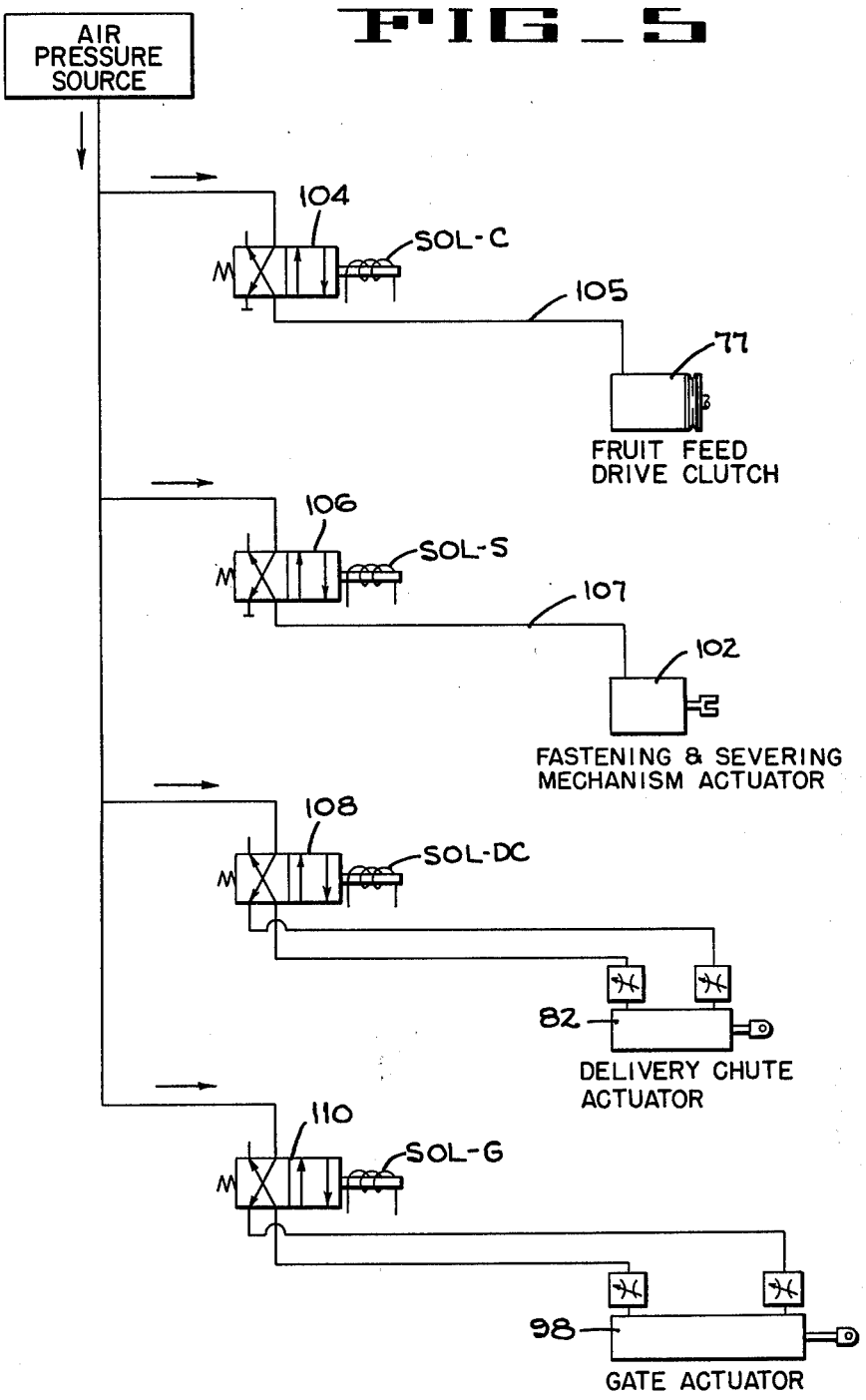
FIG. 5 is a schematic diagram of the pneumatic circuitry for the package forming and filling apparatus shown in FIG. 1.

With reference to FIG. 5 which discloses the pneumatic circuitry for operating the apparatus of the present invention, it will be seen that air under pressure is arranged to be supplied to the elevator air-actuated clutch 77 through a line 105 regulated by a solenoid-controlled directional valve 104 having two operating positions. In one position of the valve (when the control solenoid SOL-C is energized), air pressure is applied to the clutch to engage it and initiate the feeding of fruit by the elevator 14. In the other valve position, as shown in FIG. 5, air is vented from the clutch to disengage it and stop the feeding of fruit to the counter. The pneumatic actuator 102 for operating the fastening and severing mechanism 34 is similarly regulated by a solenoid-controlled directional valve 106 in line 107. When the valve 106 is shifted (by means of the energization of solenoid SOL-S) so as to provide air to the actuator 102, the actuator will operate the fastening and severing mechanism to apply the clamps 30 to the wrapping material and sever the completed bag in the manner heretofore described. Pneumatic actuator 82 for supporting the delivery chute 20 has a double-acting piston which is regulated by a solenoid-controlled directional valve 108. When solenoid SOL-DC is energized, the valve 108 is shifted to pressurize one side of the piston while venting the other side of the piston in order to swing the delivery chute 20 upwardly to its elevated position to permit the removal and replacement of the forming tube 22. When it is desired to lower the delivery chute to its operative (i.e., filling) position, the solenoid SOL-DC is de-energized to shift the position of the valve 108 and reverse the pressurizing and venting sides of the piston in the actuator 82. Similarly, pneumatic actuator 98 for controlling the movement of the gate has a double-acting piston which is regulated by a solenoid-controlled directional valve 110. When solenoid SOL-G is energized, the valve 110 is shifted to open the gate 32 and thereby cause the accumulated fruit to drop out of the forming tube; when the solenoid SOL-G is de-energized the pressurized and vented sides of the piston within the actuator 98 are reversed and the gate returns to its closed position.

Figure 6:
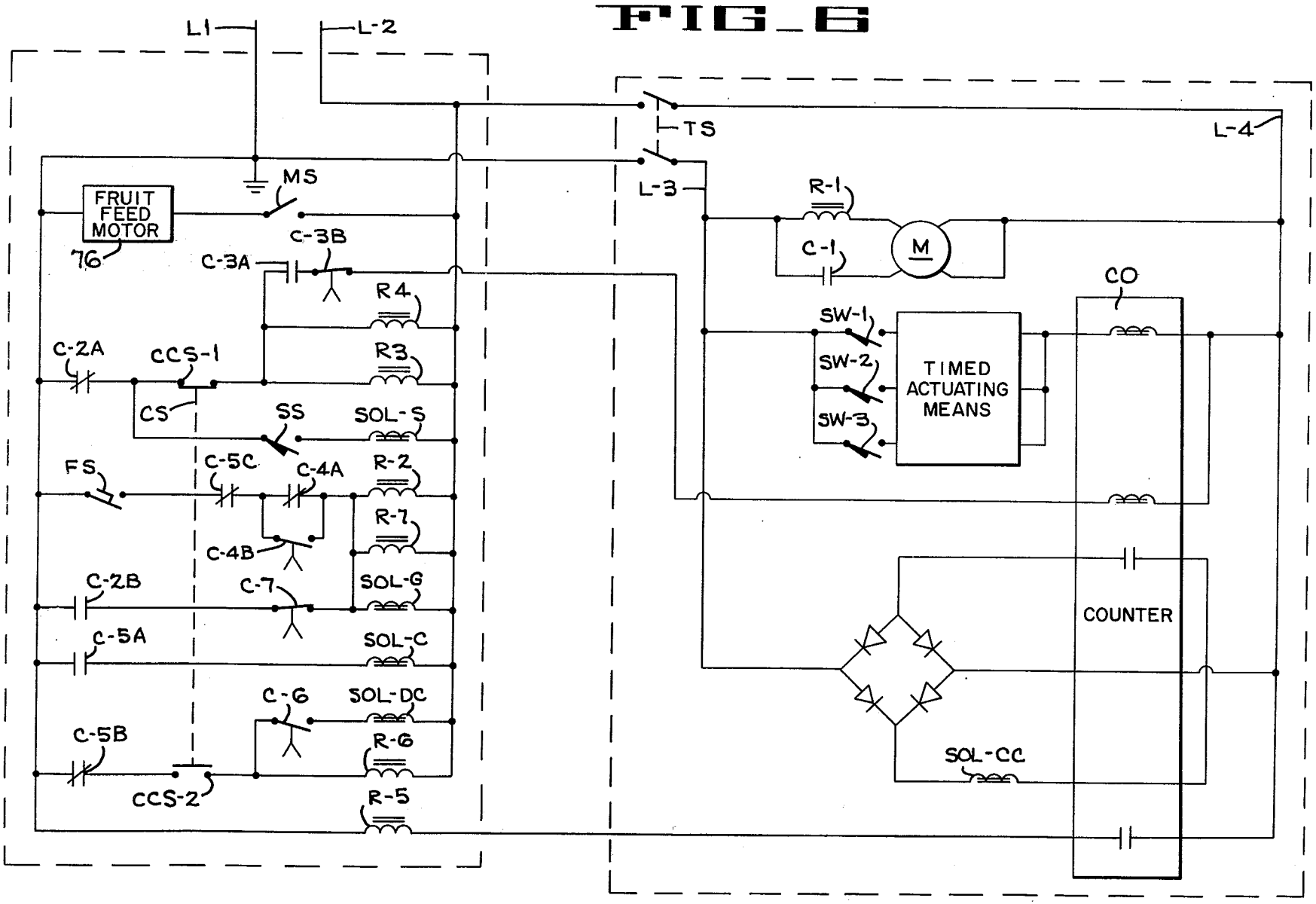
FIG. 6 is a schematic diagram of the electrical circuitry for the package forming and filling apparatus shown in FIG. 1.

The electrical control circuitry for the package forming and filling apparatus 11 is shown in FIG. 6 and will now be described in conjunction with the description of the operation of the apparatus. The circuitry will be described using the reference characters L for a line, R for a relay, C for a contact, M for a motor, and SOL for a solenoid. In the case of contacts, the numeral following the letter C is the same as that of the relay by which the contact is controlled, and a letter designation A, B or C after the numeral differentiates between multiple contacts controlled by the same relay.

The control circuitry is connected with a source of power to provide a desired voltage between line L-1 and L-2. A switch MS is closed to energize fruit feed motor 76. An ON/OFF toggle switch TS is closed to connect line L-1 with a line L-3 and to connect line L-2 with a line L-4. A starter relay R-1 between lines L-3 and L-4 is energized and closes normally open contacts C-1 to send a current through a counter motor M. This counter motor drives the V-belts 15 and the timing conveyor 16 in the counter through an electrical clutch-brake mechanism (not shown) controlled by a solenoid SOL-CC. A foot control switch FS and a stapler switch SS are normally open. A delivery chute control selector switch CS is positioned to maintain the delivery chute 20 in a down, i.e., operative, position by closing contacts CCS-1 and opening contacts CCS-2. A desired article count representing the number of articles to be packaged in each bag is set in a stepping switch within the internal circuitry of the counter CO.

To ready the apparatus 11 for operation, the foot control switch FS is depressed momentarily and then released. Upon closing of the foot control switch, a relay R-2 is energized through normally closed contacts C-5C and C-4A. The energization of relay R-2 causes normally closed contacts C-2A to open and normally open contacts C-2B to close. Upon the opening of contacts C-2A, time interval relays R-3 amd R-4 are de-energized. Upon the sebsequent opening of switch FS after it has been released, relay R-2 is de-energized, closing contacts C-2A to energize relays R-4 and R-3 through closed contacts CCS-1. Upon energization of relay R-3, contacts C-3A close immediately and a current passes through normally closed time delay contacts C-3B to reset the counter CO before contacts C-3B open after a 1 second time delay interval. Energization of relay R-4 opens normally closed contacts C-4A to prevent the opening of gate 32 by energization of solenoid SOL-G until normally open time delay contacts C-4B close after a 2 second time interval.

Once the counter is reset, relay R-5 is energized from the counter circuitry CO. Normally open contacts C-5A close to permit a current to pass therethrough to energize the clutch solenoid SOL-C and thereby operate elevator 14 to convey fruit to the V-belts 15 and the timing conveyor 16. These latter elements are also activated upon the resetting of the counter by the energization of solenoid SOL-CC by means of appropriate contacts in the counter circuitry CO. Normally closed contacts C-5B open upon energization of relay R-5 to prevent accidental energization of a relay R-6 that would elevate the delivery chute 20 during a bag filling operation if contacts CCS-2 were accidentally closed. Normally closed contacts C-5C are opened by energization of relay R-5 to disable the gate control solenoid SOL-G during a bag filling operation.

Fruit switches SW-1, SW-2, and SW-3 are actuated by contact of the actuating arms 79 with fruit F passing on the pusher chains of the timing conveyor 16, and this fruit counting and delivering operation is continued until the pre-set article count is reached. Upon completion of the pre-set article count, solenoid SOL-CC is de-energized to stop the timing conveyor 16 and relay R-5 is de-energized (by circuitry within the counter CO). Contacts C-5A open, de-energizing clutch control solenoid SOL-C and thereby disengaging clutch 77 to stop fruit feed elevator 14.

To discharge the accumulated articles from the forming tube 22, foot switch FS is manually closed, energizing relays R-2 and R-7 to close contacts C-2B, allowing a current to pass therethrough and through normally closed time delay contacts C-7 for a 2 second time interval to energize the gate control solenoid SOL-G which opens gate 32. The gate is therefore automatically maintained in an open position for the 2 second interval provided by delay contacts C-7, and, if desired, it can be maintained open for a longer period if the foot switch FS remains depressed. Normally closed contacts C-2A are opened by energization of relay R-2, and relays R-3 and R-4 are de-energized. The stapler control solenoid SOL-S is disabled when gate 32 is open because of the opening of contacts C-2A. While gate 32 is open, the wrapped articles drop from the forming tube and are caught by the operator who moves the wrapping material 24 and the enclosed articles to the fastening and severing mechanism 34.

The normally closed time delay contacts C-7 automatically open after the 2 second time interval elapses, but solenoid SOL-G will remain energized through contacts C-5C and C-4A so long as the foot switch FS remains depressed. If after the 2 second time interval elapses foot switch FS is opened, relay R-2 will be de-energized to close contacts C-2A and solenoid SOL-G will be de-energized to close the gate 32. Relay R-3 is energized to reset the counter and start the fruit feeding conveyors (in the manner previously pointed out) so that another counting and fruit filling operation can commence while the wrapping material is being fastened and severed. Thus, upon releasing the foot switch FS, the bag filling cycle is completed and the counter circuitry CO is reset to count the next batch of articles while the operator places the wrapping material 24 in the fastening and severing mechanism 34. Stapler switch SS is closed by the operator to energize the stapler control solenoid SOL-S and thus apply the clamps 30 above the packaged fruit while the next batch thereof is being delivered into the forming tube.

The above sequence continues until the quantity of wrapping material 24 on the forming tube 22 is nearly exhausted. At this time, the operator switches the delivery chute control selector switch CS to a position closing contacts CCS-2 and thereby conditions the circuitry for elevating the delivery chute 20 to permit the changing of the forming tube. The counter CO will finish the count of articles into the delivery chute, and upon de-energization of relay R-5 and closing of contacts C-5B, relay R-6 will be energized. After a 2 second time delay to permit the fruit to be discharged from the delivery chute, contacts C-6 will close and the delivery chute control solenoid SOL-DC will be energized to elevate the delivery chute. The counter circuitry CO is inoperative while the delivery chute is up because contacts CCS-1 of selector switch CS are opened to prevent the resetting of the counter, and the operator can replace the forming tube with a tube having an abundant supply of wrapping material thereon. Upon replacement of the forming tube, the selector switch CS is moved to its normal position closing the contacts CCS-1 for lowering the delivery chute, and the counter circuitry CO can then be reset to begin another bag making and filling cycle.

The package forming operation is illustrated in diagrammatic FIGS. 7–10. With reference to FIG. 7, a forming tube 22 has a supply of hose-shaped wrapping material 24 pleated axially and fitting telescopically about the outer surface of the tube with a portion of the wrapping material extending over the upper rim 26 of the tube and downwardly through the tube bore to a position below the lower rim 28 of the tube and below the gate 32 where the wrapping material is tightly gathered together and fastened by a staple or clamp 30. Fruit F is being filled into the wrapping material within the forming tube during the time that the clamp 30 is applied. The portion of wrapping material inside the tube bore continues to be filled with a quantity of fruit F to be packaged, as shown in FIG. 8, while the wrapping material and accumulated articles are supported by gate 32 at a position directly below the lower rim 28 of the tube but above the staple 30 at the fastened end of the wrapping material. In accordance with the present invention, the filling of fruit into the bag can occur prior to the application of the staple 30 to the end of the material, and, in fact, the filling will be initiated immediately after the gate is returned to its closed position and before the clamping and severing of the filled bag by the mechanism 34. Upon opening gate 32, as shown in FIG. 9, the wrapping material support is removed and the accumulated fruit drop downwardly within the wrapping material toward the end thereof fastened by staples 30. This causes a downward pull on the wrapping material to break up any bridging of fruit across the tube so that the fruit and wrapping material pass downwardly through the tube bore to a position below the tube where an operator catches them while another portion of wrapping material is fed into the tube bore. The gate 32 is then closed, as shown in FIG. 10, so that another batch of fruit can be accumulated within the tube while the operator places that portion of the wrapping material just above the first accumulated batch of fruit into the fastening and severing mechanism 34 where the wrapping material is fastened in a tightly gathered together manner at two spaced positions and severed therebetween.

It will thus be seen that the method of and apparatus for forming packages as disclosed herein will result in the breaking up of any bridging of articles in the forming tube because of the downward movement of the wrapping material between the articles and the internal surface of the tube. In the package forming operation disclosed, the steps of forming and filling one package are performed simultaneously with the steps of closing and severing the preceding package, and thus the operation is more rapid than operations in which all operations on one package must be performed before the operations on the next package can commence. The method and apparatus disclosed speeds up the packaging operation and thereby provides for economy in packaging.

Although the best mode contemplated for carrying out the present invention has been herein shown and described, it will be apparent that modification and variation may be made without departing from what is regarded to be the subject matter of the invention.

We claim:

1. A package forming apparatus comprising a forming tube having
- an outer surface,
- an upper rim,
- a lower rim, and
- an internal bore extending between the upper and lower rims,
- said forming tube being of a size and shape for receiving a supply of hose-shaped wrapping material pleated axially and fitting telescopically about the outer surface of the tube with a portion of the wrapping material extending over the upper rim of the tube and downwardly through the tube bore to a position below the lower rim of the tube;

means for feeding a quantity of articles to be packaged into the hose-shaped wrapping material within the forming tube;

a gate positioned below the lower rim of the tube for supporting the portion of wrapping material positioned inside the tube bore as said quantity of articles to be packaged are filled therein, said gate being movable to a position out of alignment with the tube bore to allow the position of wrapping material and said quantity of articles to be packaged to drop downwardly through the bore to a position below the gate and thereby feed another portion of wrapping material into the bore;

means for fastening the hose-shaped wrapping material in a tightly gathered together manner in at least one location at a level lower than the gate and above the articles to be packaged, said fastening means being located laterally of the line of fall from the lower rim of the forming tube by a distance sufficient for the gate to be moved to an article supporting position while the hose-shaped wrapping material is being fastened and sufficient to provide a tail on the package being formed into which articles can drop when the gate is moved to its position out of alignment with the bore of the tube; and means for severing the hose-shaped wrapping material below the one fastening position.

2. The package forming apparatus described in claim 1 including a counter for counting articles fed into the hose-shaped wrapping material within the forming tube, control means responsive to said counter reaching a predetermined article count for inactivating said means for feeding said articles, and means for moving the gate to the position allowing the wrapping material and articles to be packaged to drop downwardly through the forming tube bore.

3. The package forming apparatus described in claim 1 wherein said hose-shaped wrapping material is a tubular net.

4. The package forming apparatus described in claim 1 wherein said fastening means fastens the hose-shaped wrapping material at two spaced locations above the articles to be packaged, and said severing means cuts the hose-shaped wrapping material between the two spaced fastening positions.

5. In a package forming apparatus including a forming tube with an outer surface and a downwardly extending internal bore that extends between an upper rim and a lower rim of the forming tube, said forming tube being of a size and shape to receive a supply of hose-shaped wrapping material fitting telescopically about the outer surface of the tube with a portion of the wrapping material extending over the upper rim of the tube and downwardly through the internal bore; wherein said improvement comprises a gate positioned below the lower rim of the forming tube; means for moving the gate between a position in alignment with the bore of the forming tube for supporting the portion of wraping material inside the forming tube as a quantity of articles to be packaged are filled into the portion of wrapping material and a position out of alignment with said bore for allowing the portion of wrapping material in the forming tube and the articles to be packaged therein to drop downwardly through the bore to a position below the gate whereby another portion of hose-shaped wrapping material is fed into the bore for reception of the next batch of articles to be packaged; and means for fastening the hose-shaped material in a tightly gathered together manner at a location located laterally of the line of fall from the lower rim of the forming tube by a distance sufficient for the gate to be moved to an article supporting position.

6. In a package forming apparatus including a forming tube with an outer surface and a downwardly extending internal bore that extends between an upper rim and a lower rim of the forming tube, said forming tube having means for receiving a supply of hose-shaped wrapping material fitting telescopically about the outer surface of the tube with a portion of the wrapping material extending over the upper rim of the tube and downwardly through the internal bore; means for feeding articles to be packaged into the hose-shaped wrapping material within the forming tube bore; means for fastening the hose-shaped wrapping material in a tightly gathered together manner at a location below the lower rim of the forming tube; wherein said improvement comprises a gate positioned at a location above the fastening means and below the lower rim of the forming tube; means for moving the gate between a position in alignment with the internal bore of the forming tube for supporting the portion of wrapping material inside the forming tube bore as the articles to be packaged are fed into that portion of wrapping material and a position out of alignment with said bore for allowing the portion of wrapping material and the articles to be packaged to drop downwardly through the bore to a position below the gate whereby another portion of wrapping material is fed into the bore for reception of the next batch of articles to be packaged; and means for severing the hose-shaped material at a location located laterally of the line of fall from the lower rim of the forming tube by a distance sufficient for the gate to be moved to an article supporting position.

7. A method of forming a package comprised of articles wrapped in a hose-shaped wrapper, said method comprising the steps of providing a generally vertically oriented forming tube and a supply of hose-shaped wrapping material pleated axially and fitting telescopically about the outer surface of the tube with a portion of the wrapping material extending over the upper rim of the tube and downwardly through the tube bore to a position below the lower rim of the tube; gathering the end of the wrapping material together and applying a fastener thereto; filling the portion of wrapping material inside the tube bore with a quantity of articles to be packaged while supporting the wrapping material and the accumulated articles at a position directly below the tube; removing the support from the wrapping material and accumulated articles upon completion of the filling operation to drop at least some of the articles in the wrapping material from the position of support downwardly to the fastened end of the wrapping material thereby causing a downward pull on the wrapping material to break up any bridging of any other articles in the tube so that all of the articles pass downwardly through the tube bore to a position therebelow and another portion of hose-shaped wrapping material is fed into the internal bore for the reception of the next batch of articles to be packaged; returning the support to a position below the tube for supporting said next batch of articles; and severing the wrapping material at a location located laterally of the line of fall from the lower rim of the forming tube by a distance sufficient for the support to be moved to an article supporting position, said material being severed above said quantity of articles to be packaged.

8. The method of forming a package as set forth in claim 7 wherein said fastening and severing steps include fastening the hose-shaped wrapping material in a tightly gathered together manner at two closely spaced positions above the articles to be packaged; and severing the wrapping material between the two spaced fastening positions.

9. The method of forming a package as set forth in claim 8 including the further step of counting the articles being fed into the portion of wrapping material positioned within the forming tube, said removal of the support from the wrapping material and accumulated articles being initiated upon the reaching of a predetermined article count.

10. The method of forming a package as set forth in claim 8 including the further steps of catching the hose-shaped wrapping material together with the accumulated articles therein at a position below the level of the forming tube after said removal of said support; and moving the wrapping material and articles laterally of the line of fall to a position where the wrapping material is fastened nd severed.

* * * * *

UNITED STATES PATENT OFFICE

CERTIFICATE OF CORRECTION

PATENT NO. : 3,940,906

DATED : March 2, 1976

INVENTOR(S) : LEE M. LECKBAND et al

It is certified that error appears in the above-identified patent and that said Letters Patent are hereby corrected as shown below:

Column 2, line 63, "break" should be --breaks--.

Column 2, line 68, "proceding" should be --preceding--.

Column 3, line 26, "are" should be --were--.

Column 3, line 67, "counter" should be --counted--.

Column 7, line 21, "line" should be --lines--.

Column 9, line 42, "staples" should be --staple--.

Column 10, line 33, "position" should be --portion--.

Column 11, line 16, "the" should be --that--.

Column 12, line 57, "nd" should be --and--.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*